United States Patent [19]

Chang

[11] Patent Number: 4,685,977

[45] Date of Patent: Aug. 11, 1987

[54] FATIGUE-RESISTANT NICKEL-BASE SUPERALLOYS AND METHOD

[75] Inventor: Keh-Minn Chang, Schenectady, N.Y.

[73] Assignee: General Electric Company, Schenectady, N.Y.

[21] Appl. No.: 677,449

[22] Filed: Dec. 3, 1984

[51] Int. Cl.[4] ..... C22F 1/10

[52] U.S. Cl. ..... 148/12.7 N; 148/410

[58] Field of Search ..... 148/11.5 N, 12.7 N, 148/2, 410, 428

[56] References Cited

U.S. PATENT DOCUMENTS

| | | | |
|---|---|---|---|
| 2,570,193 | 10/1951 | Bieber et al. | 75/171 |
| 2,621,122 | 12/1952 | Gresham et al. | 75/171 |
| 3,046,108 | 7/1962 | Elselstein | 75/171 |
| 3,061,426 | 2/1960 | Bieber | 75/171 |
| 3,151,981 | 2/1962 | Smith et al. | 75/171 |
| 3,166,412 | 1/1965 | Bieber | 75/171 |
| 3,322,534 | 4/1965 | Shaw et al. | 75/171 |
| 3,343,950 | 9/1967 | Richards et al. | 75/171 |
| 3,575,734 | 4/1971 | Muzyka et al. | 148/2 |
| 3,576,681 | 4/1971 | Barker et al. | 148/32 |
| 4,207,098 | 6/1980 | Shaw | 75/171 |
| 4,325,756 | 4/1982 | Brown et al. | 148/428 |
| 4,366,312 | 6/1982 | Clark et al. | 428/680 |

*Primary Examiner*—R. Dean

*Attorney, Agent, or Firm*—Paul E. Rochford; James C. Davis, Jr.; Paul R. Webb, II

[57] ABSTRACT

New $\gamma'$ strengthened nickel-base superalloy compositions are described that, when forged and properly heat treated, demonstrate superior resistance to fatigue crack growth accompanied by very good high temperature properties. Parts can be fabricated (e.g., using conventional cast and wrought processing) from these alloys without encountering difficulty in forging.

16 Claims, 5 Drawing Figures

FATIGUE-RESISTANT NICKEL-BASE SUPERALLOYS AND METHOD

BACKGROUND OF THE INVENTION

Nickel-base superalloys are extensively employed in high-performance environments. However, the fabrication of current high-strength $\gamma'$-strengthened nickel-base superalloys having the best high temperature properties encounter serious problems in attempts at fabrication by forging. These problems relate to the high solvus temperature of the $\gamma'$ phase, which will have a value very close to the incipient melting temperature of the alloy.

For this reason, direct hot-isostatic pressing (HIP) of powder superalloys has been used extensively to produce large scale critical components for aircraft engines, such as turbine disks. In addition to being able to avoid the forging problems, tne near-net shape processing employed in HIP processing yields cost savings by reducing both the amount of input material required and the machining cost. However, a characteristic of this type of processing is the occurrence of internal defects, such as voids and ceramic formations in the parts formed, because of the inability of the art to produce perfectly clean powder. As a result, the performance of parts prepared in this manner may be impaired, because such defects play a key role in the response of the part material under cyclic stress. While considerable efforts has been expended to improve powder metallurgy (e.g., improvement in the cleanliness of powder processing), the nature and morphology of defects in parts made by powder processing and their role as initiation sites for cracking have never been well characterized. The development of high strength alloy compositions free of the alloy processing difficulties encountered in conventional melting, casting and forging remains an alternative solution, particularly for addressing the problem of fatigue crack growth at service temperatures. The development of the superalloy compositions of this invention focuses on the fatigue property and addresses in particular the time dependence of crack growth.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma\sqrt{a}$. Under the fatigue condition, the stress intensity in a fatigue cycle may consist of two components, cyclic and static. The former represents the maximum variation of cyclic stress intensity ($\Delta K$), i.e., the difference between $K_{max}$ and $K_{min}$. At moderate temperatures, crack growth is determined primarily by the cyclic stress intensity ($\Delta K$) until the static fracture toughness $K_{IC}$ is reached. Crack growth rate is expressed mathematically as $da/dN \propto (\Delta K)^n$. N represents the number of cycles and n is material dependent. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys. To add to the complexity of this time-dependence phenomenon, when the temperature is increased above some point, the crack can grow under static stress of some intensity K without any cyclic component being applied (i.e. $\Delta K=0$). The design objective is to make the value of da/dN as small and as free of time-dependency as possible. Components of stress intensity can interact with each other in some temperature range such that crack growth becomes the function of both cyclic and static stress intensities, i.e., both $\Delta K$ and K.

It is an object of this invention to prepare as a turbine disk material, a nickel-base superalloy [e.g., for preparing a turbine disk by the cast and wrought (C&W) process] having a composition that will guarantee that the alloy can be hot-forged on a large scale. At the same time, the strength of the alloy at room and at elevated temperatures, as well as the creep properties thereof, should be reasonably comparable to those of powder-processed alloys.

The hot workability of nickel-base superalloys in the conventional forging process depends upon the nature of the microstructure of the alloy both prior to and during forging. The as-cast ingot usually displays dendritic segregation. Large ingots of alloys having high age-hardening element content always develop heavily dendritic segregation and large dendritic spacing. Subsequent to this dendritic segregation, large concentrations of thermally stable carbide as well as other intermetallic segregation form and such formations can have a significant effect on the alloy properties. Thermal homogenization treatments can serve to diffuse such dendritic segregation. However, selection of the homogenization temperature that may be used is limited by the problem of incipient melting. Loss of forgeability and deterioration in mechanical properties are evident when even a slight amount of incipient melting occurs. In most instances, the initial ingot conversion operations begin at temperatures well above the $\gamma'$ solvus with most of the subsequent work being carried out below the $\gamma'$ solvus. The result is a fully refined structure. If the alloy exhibits a high $\gamma'$ solvus, one is forced to employ a relatively high temperature in the forging operation. This will cause coarse microstructure to form, because of the in-process annealing that occurs. Such microstructure has low ductility and is sensitive to quench cracking.

It becomes evident, therefore, that in order to develop a superalloy composition that exhibits good fatigue cracking resistance, unique selections of alloy chemistry and microstructure must be made. As will be shown hereinafter, the chemical compositions of the alloys of this invention have been selected through the application of several unconventional metallurgical considerations that control (1) the volume fraction and chemistry of the precipitation phases, (2) the selection of alloy matrix and (3) the selection of microalloy additions. In order to ensure superior resistance to fatigue crack growth in the resulting alloy, it was also necessary to determine what heat treatment should be employed in combination with the foregoing considerations to develop the proper microstructure.

Certain relationships and terminology will be utilized herein to describe this invention. The approximate conversions of weight percent to atomic percent for nickel-base superalloys of the precipitation hardening elements such as aluminum, titanium, tantalum and niobium. are set forth as follows:

Aluminum (wt%)$\times$2.1=Aluminum (at%)
Titanium (wt%)$\times$1.2=Titanium (at%)
Niobium (wt%)$\times$0.66=Niobium (at%)

Tantalum (wt%)×0.33=Tantalum (at%)

In respect to nickel the term "balance essentially" is used to include, in addition to nickel in the balance of the alloy, small amounts of impurities and incidental elements, which in character and/or amount do not adversely affect the advantageous aspects of the alloy.

More detailed characteristics of the phase chemistry of $\gamma'$ are given in "Phase Chemistries in Precipitation-Strengthening Superalloy" by E. L. Hall, Y. M. Kouh, and K. M. Chang [Proceedings of 41st. Annual Meeting of Electron Microscopy Society of America, August 1983 (p. 248)].

The following U.S. patents disclose various nickel-base alloy compositions: U.S. Pat. Nos. 2,570,193; 2,621,122; 3,046,108; 3,061,426; 3,151,981; 3,166,412; 3,322,534; 3,343,950; 3,575,734; 3,576,681, 4,207,098 and 4,336,312. The aforementioned patents are representative of the many alloying situations reported to data in which many of the same elements are combined to achieve distinctly different functional relationships between the elements such that phases providing the alloy system with different physical and mechanical characteristics are formed. Nevertheless, despite the large amount of data available concerning the nickel-base alloys, it is still not possible for workers in the art to predict with any degree of accuracy the physical and mechanical properties that will be displayed by certain concentrations of known elements used in combination to form such alloys even though such combination may fall within broad, generalized teachings in the art, particularly when the alloys are processed using heat treatments different from those previously employed.

The objectives for forgeable nickel-base superalloys of this invention are three-fold: (1) to minimize the time dependence of fatigue cracking resistance, (2) to secure (a) values for strength at room and elevated temperatures and (b) creep properties that are reasonably comparable to those of powder-processed alloys, and (3) to reduce or obviate the processing difficulties encountered heretofore.

DESCRIPTION OF THE INVENTION

This invention is directed to new $\gamma'$ strengthened nickel-base superalloy compositions which, when forged and properly heat treated, exhibit essentially time-independent fatigue cracking resistance coupled with very good tensile and rupture strength properties. Parts can be fabricated in large scale from these alloys, for example using conventional C&W processing, without encountering difficulties in forging and heat treating operations.

These alloy compositions as a minimum contain nickel, chromium, cobalt, molybdenum, tungsten, aluminum, titanium, niobium, zirconium and boron with the $\gamma'$ precipitate (the alloys of this invention are free of $\gamma''$ phase) phase being present in an amount ranging from about 42 to about 48% by volume. The forged alloy has a grain structure that is predominantly equiaxed with the grain size being about ASTM 5–6 and exhibits fatigue crack growth rates that are substantially independent of the frequency of fatigue stress intensity application with or without intermittent periods during which maximum fatigue stress intensity is applied. This fatigue cracking resistance behavior has been demonstrated at 1200° F. It is expected that this behavior will be manifested over a range of elevated temperatures (i.e., from about 750° F. to about 1500° F.).

The composition range of the alloys of this invention is set forth in TABLE I.

TABLE I

| Element | Composition (wt %) |
|---|---|
| Ni | balance |
| Cr | about 14 to about 18 |
| Co | about 10 to about 14 |
| Mo | about 3.0 to about 5.0 |
| W | about 3.0 to about 5.0 |
| Al | about 2.0 to about 3.0 |
| Ti | about 2.0 to about 3.0 |
| Nb | about 2.0 to about 3.0 |
| Ta | 0.0 to about 3.0 |
| Ti + Nb/2 + Ta/4 | about 3.5 to about 5.0 |
| Zr | about .02 to about .08 |
| B | about .01 to about .05 |
| C | less than about 0.10 |

As is conventional practice, the addition of adequate trace amounts of scavenger elements such as magnesium, cerium, hafnium, or other rare earth metals, is recommended for charging into the melting heat. However, the residual concentration of these elements must be kept as low as possible (e.g., less than about 50 ppm each).

In each instance, the alloy composition is selected so as to develop about 42–48% by volume of strengthening $\gamma'$ precipitate phase. Such volume fraction of $\gamma'$ precipitate has been found to provide the requisite ingot forgeability. The preferred volume percent of $\gamma'$ precipitate phase is about 45%. Alloy strength and phase stability are optimized through the control of precipitate chemistry. The atomic percent of Nb+Ta in total hardening element content (i.e., Al+Ti+Nb+Ta) is to be 20–25%. The chromium content provides the requisite alloy environmental resistance.

Standard superalloy melting practice [vacuum induction melting (VIM)+vacuum arc re-melting (VAR) or VIM+electro slag re-melting (ESR)] can be used to prepare the ingot of these new alloy compositions. Subsequent thermal and mechanical processing to be employed will depend upon obtaining comprehensive information on the characteristic phase transition temperature of the superalloy composition selected. Among the many different methods available for determining the phase transition temperature of a superalloy there are two methods most commonly used. The first method is differential thermal analysis (DTA) as described in "Using Differential Thermal Analysis to Determine Phase Change Temperatures" by J. S. Fipphen and R. B. Sparks [Metal Progress, April 1979, page 56]. The second method requires the metallographic examination of a series of samples, which have been cold-rolled (about 30% reduction) and then heat treated at various temperatures around the expected phase transition temperature. Each of these methods is conducted on samples before subjecting the samples to forging. The $\gamma'$ precipitate solvus of alloy compositions of this invention will usually be in the range of from 1050°–1100° C.

Incipient melting temperature, even though it is directly related to ingot size and the rate at which the ingot casting is cooled, will have a value above 1250° C. for the alloy chemistry of this invention. The resulting wide "processing" temperature range established by this invention between incipient melting and the $\gamma'$ solvus allows for the requisite flexibility in setting processing parameters and tolerance in chemical and operational variations to provide for trouble-free forging operations.

Because of a reduced hardening element content compared to that content used in powder metallurgy (P/M) high strength superalloys, the alloy compositions of this invention are expected to develop less pronounced dendritic segregation than the aforementioned superalloys under the same casting conditions. Homogenization temperature for these compositions will range from about 1175° C. to about 1200° C. time periods that will depend on the severity of dendritic segregation in the cast ingot.

The practice of converting ingot to billet is a most important intermediate step to obtaining the best possible microstructure before subjecting the alloy to the final forging. Initial ingot conversion operations are carried out at temperature in the range of about 1150° to about 1175° C., well above the $\gamma'$ solvus temperature of about 1050° C. to about 1100° C. Repeated working is necessary to completely refine the original ingot structure into a billet and prevent the carryover of cast microstructure into the final forged shape. Preferably the final forging is started at a temperature about 5° to about 25° C. above the $\gamma'$ solvus. Most of the final forging operation is carried on at temperatures below the $\gamma'$ solvus. However, the temperatures are still high enough to avoid excessive warm work straining and the consequent presence of uncrystallized microstructure in the final shape.

The forged shape is subjected to a specific heat treatment schedule to obtain the full benefit of this invention. The solution annealing temperature is chosen to be 5°-15° C. above the recrystallization temperature, the recrystallization temperature having been determined by carrying out either of the above-noted analytical techniques using forged samples. The recrystallization temperature for alloy compositions included in this invention will usually be in the range of from about 1050° to about 1100° C. Subsequent controlled cooling from the annealing temperature is a most essential processing step for achieving the desired fatigue cracking resistance. The controlled cooling rate to be employed is required to be in the range of from about 80° to about 150° C./min. It is necessary to cool the annealed forging to a temperature of about 500° C. or less in order to prevent any further thermal reaction from occurring therein. After solution annealing, the alloy is subjected to aging treatment at temperatures between about 600° C. and about 800° C. The solution annealing is conducted for a period ranging from about 1 to about 4 hours; the aging is carried out over a period ranging from about 8 to about 24 hours. Measurement of the times for annealing and aging begins after the operative temperature has been reached in each instance.

The heat treatment schedule specified for any given alloy composition should produce a grain structure that is substantially completely composed of equiaxed grains having an ASTM 5-6 grain size (i.e., about 50 micrometers).

Although forged alloy bodies produced in the practice of the general teachings of this invention, which have a grain content that is predominantly (i.e., as little as 80% by volume) equiaxed, can have useful applications, it is preferred that substantially all of the grain content be equiaxed. This latter condition will result as long as the solution anneal is conducted at the correct temperature (i.e., about 5°-15° C. above the recrystallization temperature) and the rest of the alloy chemistry and processing parameters are applied.

BRIEF DESCRIPTION OF THE DRAWING

The features of this invention believed to be novel and unobvious over the prior art are set forth with particularity in the appended claims. The invention itself, however, as to the organization, method of operation and objects and advantages thereof, may best be understood by reference to the following description taken in conjunction with the accompanying drawings wherein:

METHOD AND PROCESS OF MAKING AND USING THE INVENTION

Figure 1:
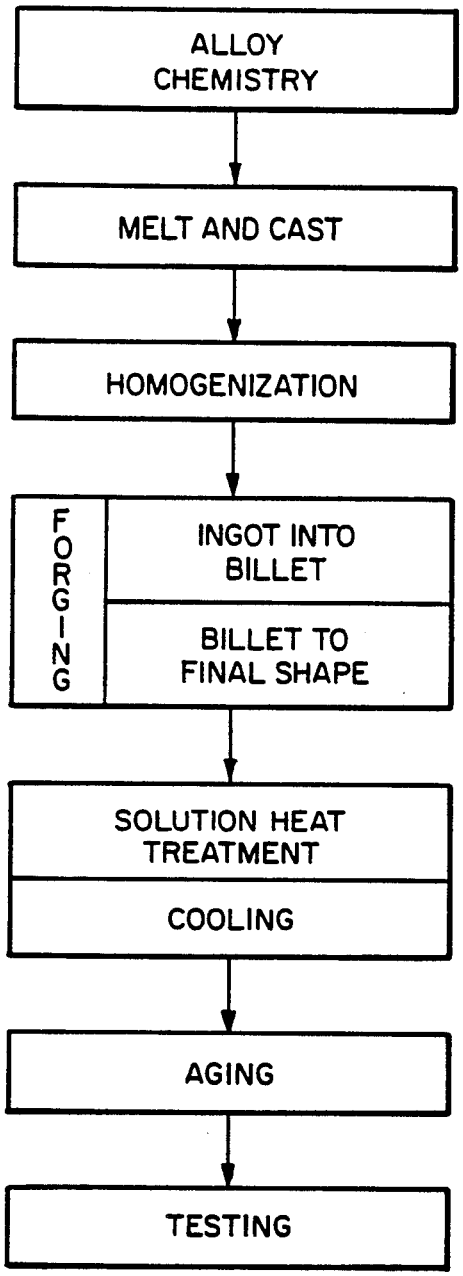
FIG. 1 presents a flow sheet schematically displaying the sequence of processing steps used in preparing forged shapes and FIGS. 2-5 are graphic (log-log plot) representations of fatigue crack growth rates (da/dN) obtained at various stress intensities ($\Delta K$) for different alloy compositions at elevated temperatures under cyclic stress applications at a series of frequencies one of which cyclic stress applications includes a hold time at maximum stress intensity.

The processing of alloys in connection with this invention followed the general sequence of steps set forth in FIG. 1. Thus, once a proposed alloy composition was established, component materials were assembled to yield the desired elemental content (i.e., alloy chemistry) for the alloy. In laboratory experiments these materials were induction-melted and cast into a cylindrical copper mold ($3\frac{5}{8}''$ in diameter and $8\frac{1}{2}''$ long) to yield an ingot. A thin slice was removed from the bottom end of each ingot for pre-forge study. The resulting ingots were subjected to homogenization treatment (1200° C. for 24 hours) under vacuum. About $\frac{1}{8}''$ of material was removed from the outside diameter of each ingot by machining and the ingots were dye-checked for defects. Any defect detected was removed by hand grinding. The forging operation consisted of two steps; first a step in which the ingot was converted to a billet and then the step in which the billet was subjected to the final forging. Thereafter solution annealing, cooling and aging were conducted in turn on the final shape. The forged shape was then tested.

Initially the efforts made at improving the hot-workability of nickel-base superalloys (i.e., by conventional forging) in connection with this invention followed the current wisdom. Thus, it was accepted (1) that in order to reduce the solvus temperature of the hardening $\gamma'$ phase, the $\gamma'$ strengthening content should be reduced and (2) that to avoid the undesirable presence of coarse carbides, the carbon level was to be kept extremely low relative to the carbon content of commercial grades. Following these teachings a series of C&W nickel-base superalloys shown in TABLE II (contents in wt%) were prepared. The carbon content in all these alloys was set at an extremely low level with the major alloying contents including Co, Cr and either Mo or W, these latter constituting the austenite matrix with Ni. Microalloying additions of Hf, Zr and B were introduced to improve grain boundary properties and creep ductility. The amounts of precipitation hardening $\gamma'$ formers, Al, Ti and Nb used were less than the amounts employed in nickel-base superalloys intended to be processed by powder metallurgy. The volume fraction of $\gamma'$ phase after aging was determined to be about 40%.

TABLE II

| Ni | Co | Cr | Mo | W | Al | Ti | Nb | Hf | Zr | B | C |
|---|---|---|---|---|---|---|---|---|---|---|---|
| bal. | 7.0 | 11.0 | — | 3.2 | 2.8 | 2.1 | 2.4 | — | .05 | .01 | .01 |
| bal. | 10.0 | 13.5 | — | 4.8 | 2.8 | 2.1 | 2.4 | .16 | — | .01 | .01 |
| bal. | 17.0 | 15.0 | 5.0 | — | 3.2 | 2.8 | — | — | .05 | .02 | .01 |
| bal. | 18.5 | 12.4 | 3.2 | — | 3.2 | 2.8 | 1.0 | .16 | .06 | .02 | .01 |

The 7 wt% Co alloy was successfully cast and only minor cracks developed on the surfaces of this specimen during forging. In the case of the 10 wt% Co alloy, casting was successful, but serious cracks occurred during the forging operation. Extensive defects were present on the casting of the 17 wt% Co alloy and, therefore, this ingot was not forged. The 18.5 wt% Co alloy was successfully cast and, as in the case of the 7 wt% Co alloy, only minor cracks developed on the surfaces of the specimen during forging. The conditions employed during forging are set forth in TABLE III.

TABLE III

| Co Content (wt %) | Initial Forge Temp. (°F.) | Last Push Forge Temp. (°F.) | Last Push Height Reduction (%) |
|---|---|---|---|
| 7.0 | 2050 | 2050 | 50.6 |
| 10.0 | 2050 | 2050 | 48.5 |
| 18.5 | 2080 | 2025 | 42.6 |

Property evaluations were made on the 7 wt% Co forging (tensile and rupture) and the 18.5 wt% Co forging (tensile) after each had been subjected to heat treatment. The 7 wt% Co forging was solution annealed at 1050° C. for 1 hour, cooled and then aged at 760° C. for 16 hours; the 18.5 wt% Co forging was solution annealed at 1110° C. for 1 hour, cooled and then aged at 760° C. for 16 hours. TABLES IV and V set forth the properties exhibited on test.

TABLE IV

| Forging | (Tensile Properties) Test Temp °F. | Y.S. (Ksi) | T.S. (Ksi) | Elongation (%) |
|---|---|---|---|---|
| 7 wt % Co | RT* | 147 | 210 | 27 |
| 7 wt % Co | 1000 | 143 | 196 | 20 |
| 7 wt % Co | 1200 | 142 | 191 | 19 |
| 18.5 wt % Co | RT | 157 | 206 | 25 |
| 18.5 wt % Co | 1200 | 147 | 191 | 25 |

*Room temperature (i.e., ~68-72° F.)

TABLE V

| Forging | (Rupture Properties) Test Temp °F. | Test Load (Ksi) | Life (hr) | Elongation (%) |
|---|---|---|---|---|
| 7 wt % Co | 1200 | 125 | 36 | 3.3 |
| 7 wt % Co | 1300 | 100 | 11 | 2.9 |

The above-described initial effort fell short of the mark in respect to both the fixing of the alloy composition and the establishment of the heat treatment operations to be used.

In the next attempt at improving the hot workability of nickel-base superalloys, in addition to using a lower volume fraction (about 40±3%) of $\gamma'$ strengthening precipitate phase and very low carbon content, the investigation was redirected to focus on achieving good fatigue cracking resistance in the alloy body as the primary goal, a clearly unconventional approach although fatigue crack resistance at elevated temperatures is one of the most critical material properties for gas turbine disk applications. New emphasis was placed on (1) the control of the chemistry of the $\gamma'$ precipitate phases, (2) the chemistry of the alloy matrix, (3) the use of microalloying additions and (4) redefinition of the heat treatment operations. With respect to the $\gamma'$ precipitate phase, the supersaturation of precipitation-hardening elements, including Al, Ti, Nb and Ta, was set at 10 at% at the aging temperature. In respect to the chemistry of the precipitates, the atomic percentage of Nb+Ta in the total of the precipitate element addition was fixed as being greater than about 15 at%, but less than about 30 at% with the Al at%:Ti at% ratio being between about 1.0 and about 2.0. To enhance high-temperature properties and oxidation resistance, the content of such substitutional alloying elements as Cr, Co, Mo, W, Re, etc. was increased as much as possible without incurring the formation of detrimental phases such as the $\sigma$-phase. Both B and Zr were to serve as microalloying elements to improve the creep properties.

An example of the resultant composition, is set forth in TABLE VI.

TABLE VI

| Element | Weight % |
|---|---|
| Ni | Balance |
| Cr | 14.0 |
| Co | 8.0 |
| Mo | 3.5 |
| W | 3.5 |
| Al | 2.5 |
| Ti | 2.5 |
| Nb | 2.5 |
| Zr | 0.05 |
| B | 0.01 |
| C | 0.01 |

A 25 lb. ingot was induction-melted under argon atmosphere. The ingot was forged and was heat treated as follows: 1100° C./1 hr.+760° C./16 hrs. After the annealing at 1100° C. the forging was salt bath (500° C.) quenched, which provides cooling at the rate of about 250° C./min. Salt bath quenching is a cooling method typically employed to control tensile strength. Stress rupture properties for this alloy are shown in TABLE VII and the tensile properties measured at various temperatures are shown in TABLE VIII.

TABLE VII

| Initial Set-up | Life (hr) | Elongation (%) |
|---|---|---|
| 1400° F./80 ksi | 97 | 3.1 |

TABLE VIII

| | RT | 1000° F. | 1200° F. |
|---|---|---|---|
| Yield Strength (Ksi) | 162 | 158 | 155 |
| Tensile Strength (Ksi) | 206 | 198 | 196 |
| Elongation (%) | 27 | 22 | 21 |
| Reduction in Area (%) | 30 | 30 | 30 |

The graphs shown as FIGS. 2-5 do not set forth individual data points, but present as each curve a copy of the computer-generated straight line represented by the relationship $$da/dN = A(\Delta K)^n$$

for the actual data points of that curve, when plotted using log-log scales. The actual data points for each plot, because of data scattering, occur in a band (not shown) much wider than the line generated therefrom with the actual data points falling on both sides of each line. When there is a clustering and even actual overlap in the data scatter bands for the three waveforms (in which case the lines therefor are closely spaced, touch or cross), this is considered as verification of substantial time-independence of the fatigue cracking resistance of the alloy being tested.

Figure 2:
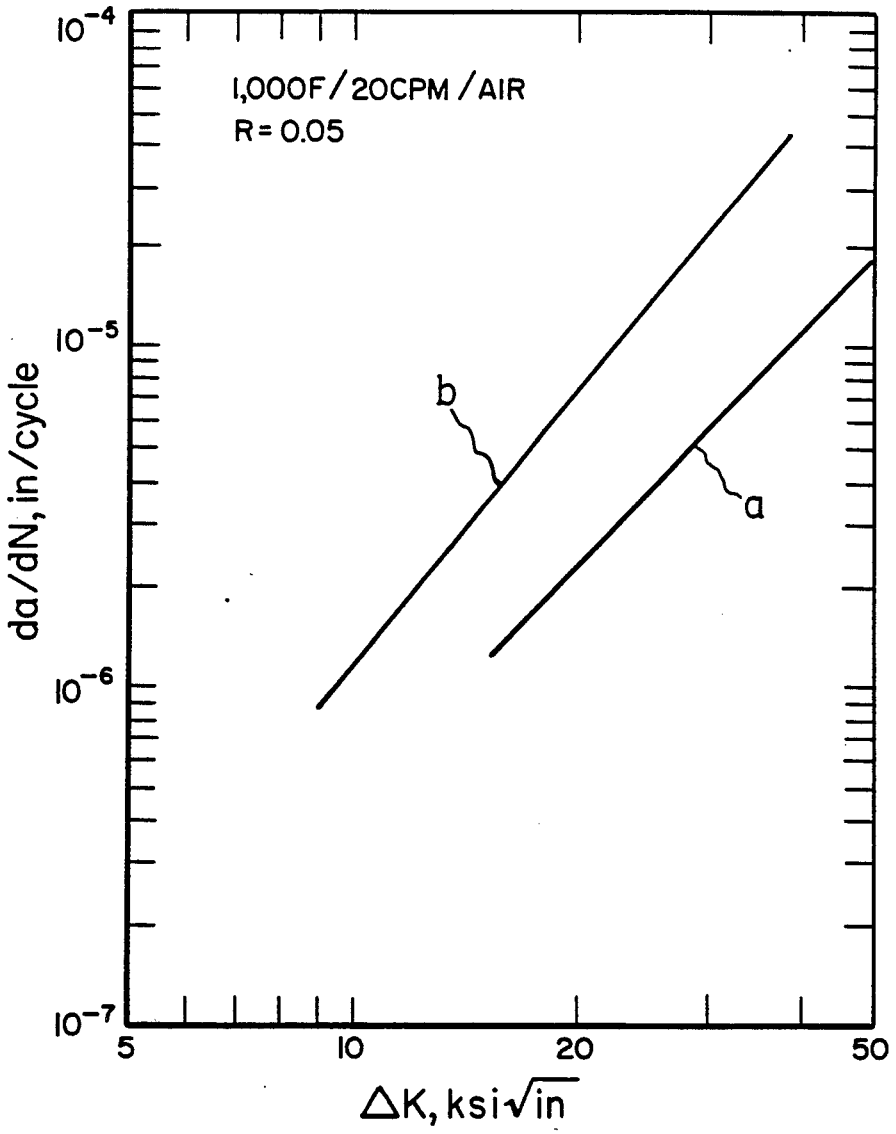
Figure 3:
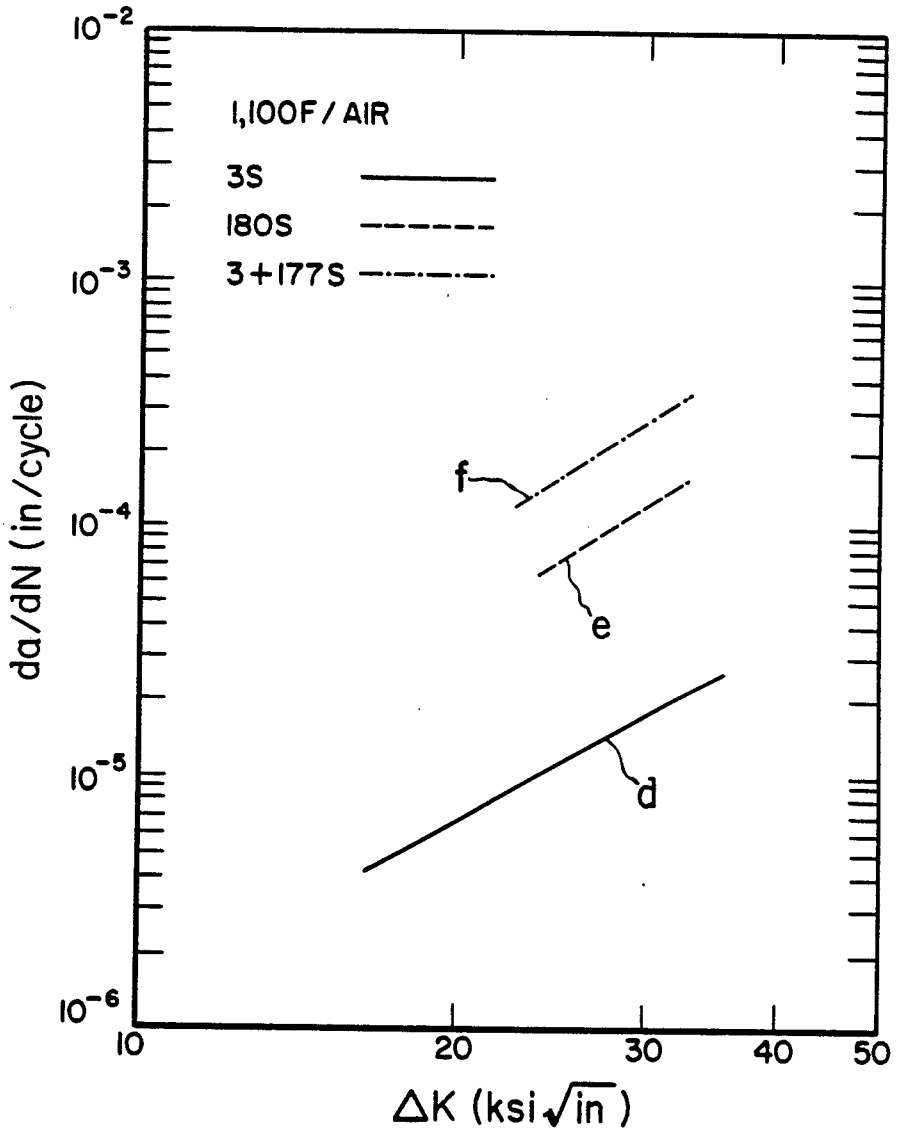
Figure 4:
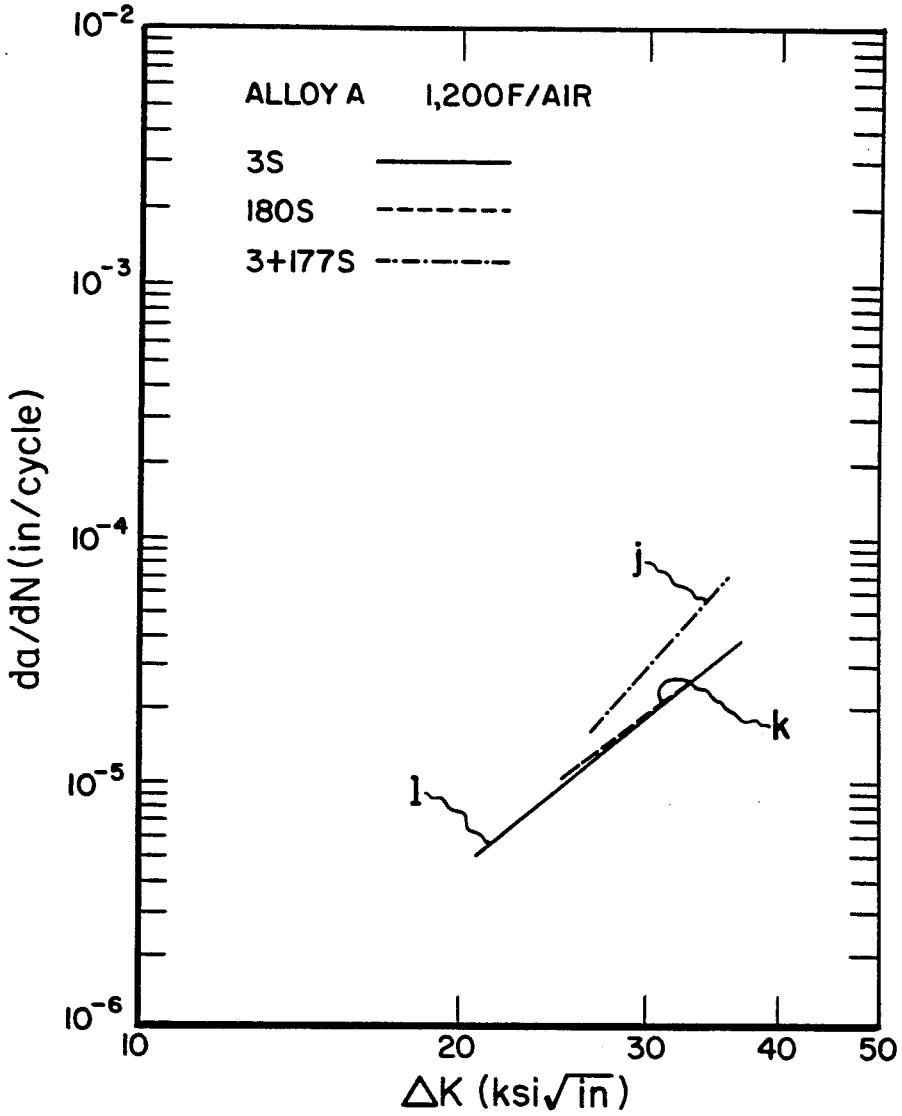
Figure 5:
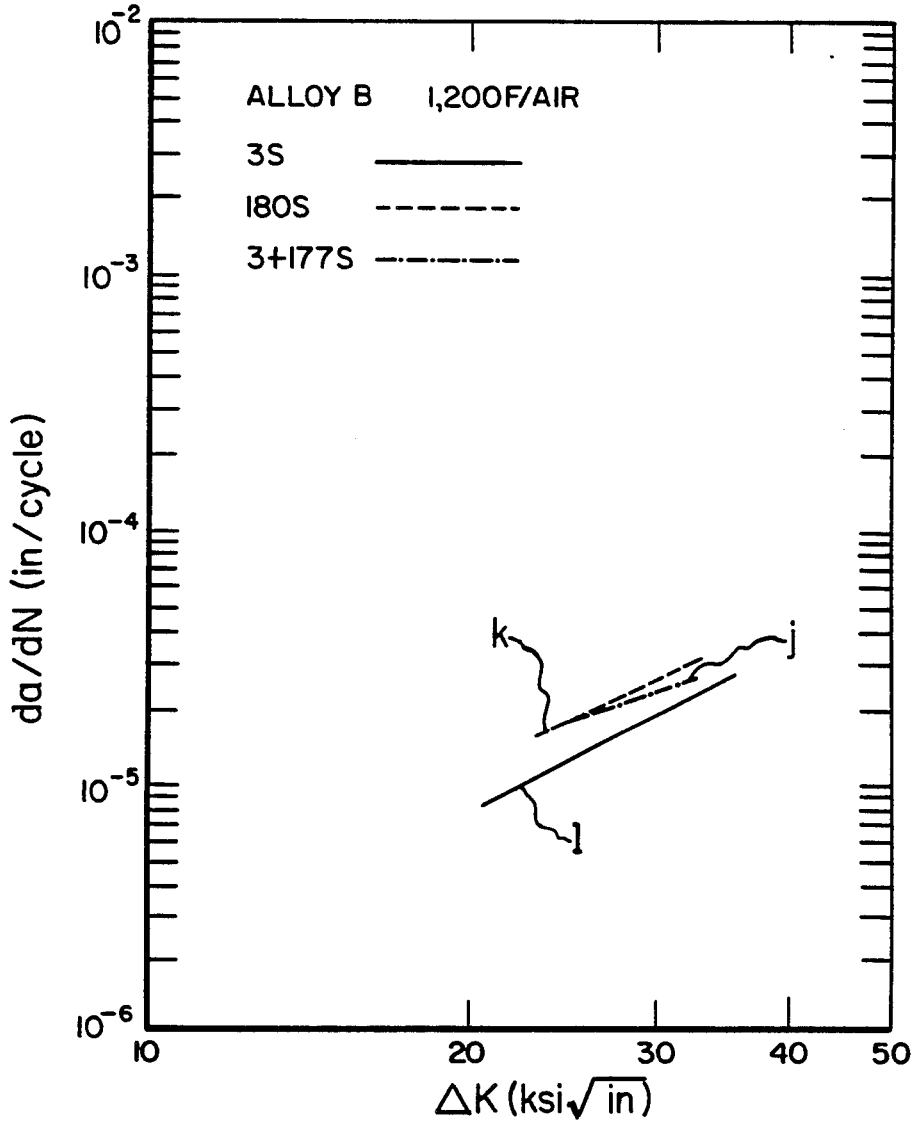

FIG. 2 displays the fatigue crack growth rate (da/dN) for the alloy of TABLE VI as a function of stress intensity ($\Delta K$) measured at 1000° F. with the stress applied at a frequency of 20 cpm (i.e., a cycle period of 3 seconds). The test data obtained for the alloy composition of TABLE VI is set forth as curve a and the test data obtained for a specimen of Rene 95 (prepared by powder metallurgy) is set forth as curve b. R, the fatigue cycle ratio, is the ratio of $K_{min}$ to $K_{max}$. In each of FIGS. 2–5 R has a value of 0.05. As is clear from the curves, the alloy composition of TABLE VI displays a 3- to 4-fold improvement over Rene 95, a commercial high strength P/M superalloy.

In order to more exhaustively investigate the time-dependence of fatigue crack propagation in addition to using sinusoidal waveform applied stress at the cyclic frequency of 20 cpm, two additional modes of cyclic stress imposition were empolyed; namely, the use of a sinusoidal waveform having the cyclic frequency of 0.33 cpm and the use of 177 seconds of hold time at maximum load between spaced cycles having a 20 cpm sinusoidal waveform. Thus, each of the latter waveforms had the same cycle period; i.e., 180 seconds.

It was found in this testing that the crack growth rate increases when the frequency of stress imposition decreases from 20 cpm to 0.33 cpm or to 20 cpm plus 177 seconds of hold time. This fact is graphically illustrated in FIG. 3 wherein fatigue crack growth rate is shown as a function of stress intensity for the alloy composition of TABLE VI at the three different modes of stress imposition at 1100° F. It was observed that the spread between curves d, e and f seen in FIG. 3 for testing in air substantially disappears (i.e., the curves overlap significantly) when the testing is done in vacuum. This observation prompted the preparation and testing of a number of compositions in which the chromium content was maximized to increase the environmental (i.e., oxidation) resistance to determine whether the time-dependent fatigue crack propagation for these alloys would be improved. As it developed, these alloys were difficult to forge and displayed both a reduction in ductility and a reduction in creep strength. Contrary to expectations, maximizing of the chromium content does not provide the sufficient suppression of time-dependent fatigue crack propagation in nickel-base superalloy compositions.

The effect of heat treatment on the metallography of the alloy microstructures developed received particular attention as part of these investigations. Annealing temperatures above the $\gamma'$ solvus were found to promote the development of large grain size (i.e., greater than 100 micrometers), while annealing temperatures far below the $\gamma'$ solvus maintained the forged grain structure. Different recrystallized grain structures develop depending upon the forging history and the degree of recrystallization. Alloy strength was found to rise significantly when annealing of the forged alloy was carried out just below the $\gamma'$ solvus temperature. Refining grain size by recrystallization and retaining residual strains are major factors contributing to the increase in strength. The effect of alloying elements on the $\gamma'$ solvus temperature has been investigated and it has been reported in the article by R. F. Decker "Strengthening Mechanism in Nickel-Base Superalloys" [Proceeding of Steel Strengthening Mechanisms Symposium, Zurich, Switzerland (May 5–6, 1969, page 147)] that most solid-solution strengtheners decrease the solubility of precipitation hardening elements. On the basis of this behavior, the assumption has been that $\gamma'$ solvus temperature increases, when more solid-solution strengthener (i.e., Cr, Co, Fe, Mo, W, V) is added. In contrast thereto, investigations in arriving at this invention have shown that increases in the content of Co and Cr actually tend to decrease the $\gamma'$ solvus with the effect being more pronounced for Co. On the other hand, $\gamma'$ solvus does increase by adding the refractory metal elements Mo and W.

Efforts (not reported herein) to optimize the Cr and Co content for alloys of this invention resulted in a reduced precipitate solvus temperature and improved high temperature properties for these alloys. These efforts were followed by studies (also not reported herein) to reduce the impurity content, to improve the latitude in conditions required for the forging operation and to select a specific heat treatment schedule to be employed.

Finally, by combining the improved compositional and processing aspects determined in these investigations, the alloy composition described in TABLE I was established together with a processing protocol meeting the following general guidelines:

(1) final forging (i.e., of the billet) is to be started at a temperature 5° to 25° C. higher than the $\gamma'$ precipitate solvus;

(2) a specific heat treatment schedule is to be employed for the forging, the solution annealing temperature being 5° to 15° C. above the recrystallization temperature with cooling from the annealing temperature to be at a rate ranging from about 80° to about 150° C./min and (3) after solution annealing the alloy is to be subjected to aging at temperatures in the range of between about 600° C. and about 800° C. for times ranging from about 8 hours to about 24 hours.

Two alloys having compositions falling within the compositional range of TABLE I are set forth in TABLE IX.

TABLE IX

| Designation | Composition (wt %) |
|---|---|
| A | Ni—16Cr—12Co—5Mo—5W—2.5Al—2.5Ti—2.5Nb—2.5Ta—0.05Zr—0.01B—0.075C |
| B | Ni—16Cr—12Co—5Mo—5W—2.5Al—3.0Ti—3.0Nb—0.05Zr—0.01B—0.075C |

For each composition, a 50 lb. heat was vacuum induction melted (VIM) and was cast into a 4" diameter copper mold under argon atmosphere. Ingots were homogenized at 1200° C. for 24 hours in vacuum and then converted into a 2" thick disk-shape body using a hot-die press. The final forging step was performed at 1100° C. with 50% reduction in height. The heat treatment schedule was selected as follows:

1100° C., 1 hour, chamber cooling (~100° C./min)

+760° C., 16 hours, chamber cooling (~100° C./min)

Fatigue cracking resistance was measured at 1200° F. by using three different waveforms: 3 sec (i.e., 20 cpm), 180 sec (i.e., 0.33 cpm) and 3 sec+177 sec (20 cpm+177 sec hold at maximum load). Crack growth rate data of two alloys using these three waveforms displayed as curves j, k and l, respectively, are plotted in FIG. 4 and FIG. 5. The variation of da/dN for these alloys with each of the waveforms is considered negligible within experimental accuracy and the closeness of lines j, k and l shown and the actual overlap of at least some of the data scatter bands obtained using the three different waveforms establishes that both alloys exhibit substantially time-independent fatigue cracking resistance at the testing conditions.

Temperature capability under load was evaluated by stress rupture testing at 1400° F. with 75 ksi initial load. TABLE X summarizes the results. Both alloys show more than 300 hours rupture life in contrast to less than 30 hours for P/M Rene 95.

TABLE XI lists tensile properties of these same alloys measured at two elevated temperatures. About 20 ksi difference in yield strength is found between new alloys A and B and P/M Rene 95, although ultimate tensile strength is equivalent.

TABLE X

| Alloy | Life(hr) | Elong.(%) | Reduction in Area (%) |
|---|---|---|---|
| A | 339 | 8.4 | 11 |
| B | 345 | 6.0 | 18 |
| P/M Rene 95 | 24 | 9.6 | 13 |

TABLE XI

| Alloy | 1200° F. Y.S. (Ksi) | 1200° F. T.S. (Ksi) | 1400° F. Y.S. (Ksi) | 1400° F. T.S. (Ksi) |
|---|---|---|---|---|
| A | 142 | 201 | 137 | 170 |
| B | 138 | 195 | 139 | 168 |
| P/M Rene 95 | 165 | 202 | 159 | 162 |

Investigations to determine what improvements in alloy strength could be achieved by changing the aging treatment had surprising results. The results obtained by variations both in aging temperature and in the duration of the aging treatment in the processing of alloys A and B are shown in TABLE XII (all other processing conditions being the same as previously reported herein).

TABLE XII

| Alloy | Aging Treatment | 200° F. Y.S. (Ksi) | 1200° F. T.S. (Ksi) |
|---|---|---|---|
| A | 760° C./16 hrs | 142 | 201 |
| | 775° C./8 hrs | 153 | 208 |
| | 775° C./8 hrs +700° C./10 hrs | 153 | 203 |
| B | 760° C./16 hrs | 138 | 195 |
| | 775° C./8 hrs | 150 | 209 |
| | 775° C./8 hrs +700° C./10 hrs | 167 | 230 |
| P/M Rene 95 | 760° C./16 hrs | 165 | 202 |

When two-stage aging is employed to optimize yield and tensile strengths, the second stage of the aging treatment should be carried out at a temperature about 50° to 150° C. lower than the first stage of the aging treatment.

Additional test data for alloy A showing the effect of solution heat treatment on tensile properties at 1200° F. is set forth in TABLE XIII. The test specimen was forged at 1075° C. (1967° F.) with a height reduction of 48.7% and aged at 760° C. for 16 hours.

TABLE XIII

| Solution Treatment | Y.S. (Ksi) | T.S. (Ksi) | Elongation (%) |
|---|---|---|---|
| As forged | 201 | 255 | 14 |
| 1050° C./1 hr | 159 | 225 | 18 |
| 1075° C./1 hr | 166 | 235 | 19 |
| 1100° C./1 hr | 153 | 209 | 10 |

It has, therefore, been demonstrated that by the combined (a) selection of alloy compositions so as to properly control the volume fraction and chemistry of the $\gamma'$ phase, the alloy matrix composition and the microalloying content and (b) use of specific mechanical and thermal processing that insures the generation and retention of beneficial microstructure, this invention has made it possible to produce forged nickel-base superalloy shapes having resistance to fatigue crack growth superior to, and strength properties comparable to, nickel-base superalloy shapes prepared by powder metallurgy.

What I claim as new and desire to secure by Letters Patent of the United States is:

1. A forged body of predetermined shape made of nickel-base superalloy consisting essentially of:

| Element | Composition (wt %) |
|---|---|
| Cr | about 14 to about 18 |
| Co | about 10 to about 14 |
| Mo | about 3.0 to about 5.0 |
| W | about 3.0 to about 5.0 |
| Al | about 2.0 to about 3.0 |
| Ti | about 2.0 to about 3.0 |
| Nb | about 2.0 to about 3.0 |
| Ta | 0.0 to about 3.0 |
| Ti + Nb/2 + Ta/4 | about 3.5 to about 5.0 |
| Zr | about .02 to about .08 |
| B | about .01 to about .05 |
| C | less than about 0.10 |

and having present therein $\gamma'$ precipitate phase in an amount from about 42 to about 48% by volume;

the grain structure of said superalloy being predominantly equiaxed; said superalloy exhibiting fatigue crack growth rates substantially independent of the waveform and frequency of fatigue stress intensity cyclically applied thereto at elevated temperatures.

2. The forged nickel-base superalloy body as recited in claim 1 wherein the alloy composition consists essentially of (in weight percent) about 14% to about 18% chromium, about 10% to about 14% cobalt, about 3% to about 5% molybdenum, about 3% to about 5% tungsten, about 2% to about 3% aluminum, about 2% to about 3% titanium, about 2% to about 3% niobium, up to about 3% tantalum, about 0.02% to about 0.08% zirconium and about 0.01% to about 0.05% boron and the balance essentially nickel.

3. The forged nickel-base superalloy body as recited in claim 2 wherein the sum of one-half the total content of titanium and niobium plus one-fourth the tantalum content is in the range of from about 3.5% to about 5%.

4. The forged nickel-base superalloy body as recited in claim 2 wherein the composition is Ni-16Cr-12Co-5Mo-5W-2.5Al-2.5Ti-2.5Nb-2.5Ta-0.05Zr-0.01B-0.075C.

5. The forged nickel-base superalloy body as recited in claim 2 wherein the composition is Ni-16Cr-12-Co-5Mo-5W-2.5Al-3.0Ti-3.0Nb-0.05Zr-0.01B-0.075C.

6. The forged nickel-base superalloy body as recited in claim 1 wherein the total of niobium content (in at%) and tantalum content (in at%) is in the range of from about 15 to about 30% of the total content (in at%) of niobium, tantalum, aluminum and titanium and the ratio of aluminum content (in at%) to titanium content (in at%) is in the range of between about 1.0 and about 2.0.

7. The forged nickel-base superalloy body as recited in claim 1 wherein the grain structure is substantially all equiaxed with ASTM 5–6 grain size.

8. The forged nickel-base superalloy body of claim 1 exhibiting a yield strength at 1200° F. in excess of 150 ksi and tensile strength at 1200° F. in excess of 200 ksi.

9. The forged nickel-base superalloy body of claim 1 exhibiting stress rupture life of greater than 300 hours at 1400° F. with 75 ksi initial load.

10. The forged nickel-base superalloy body of claim 1 wherein the percentage of total hardening element content (in at%) represented by niobium and tantalum is in the range of 20 to 25 percent.

11. The method of preparing a forged nickel-base superalloy body having its grain structure substantially all equiaxed with the grain size being about ASTM 5–6, said superalloy exhibiting fatigue crack growth rates at elevated temperatures largely independent of the waveform and frequency of fatigue stress intensity cyclically applied thereto, said method comprising the steps of:

(a) preparing an initial alloy consisting essentially of a mass having a composition in the range defined by the following table with the balance essentially nickel:

| Element | Composition (wt %) |
|---|---|
| Cr | about 14 to about 18 |
| Co | about 10 to about 14 |
| Mo | about 3.0 to about 5.0 |
| W | about 3.0 to about 5.0 |

-continued

| Element | Composition (wt %) |
|---|---|
| Al | about 2.0 to about 3.0 |
| Ti | about 2.0 to about 3.0 |
| Nb | about 2.0 to about 3.0 |
| Ta | 0.0 to about 3.0 |
| Ti + Nb/2 + Ta/4 | about 3.5 to about 5.0 |
| Zr | about .02 to about .08 |
| B | about .01 to about .05 |
| C | less than about 0.10 |

(b) forging said initial alloy mass to produce an alloy body of predetermined shape, said forging being initiated at a temperature in the range of from about 5° to about 25° C. higher than the $\gamma'$ precipitate solvus temperature, (c) solution annealing said alloy body for a period ranging from about 1 to about 4 hours at a temperature in the range of from about 5° to about 15° C. above the recrystallization temperature of the forged alloy, (d) cooling said alloy body at a rate in the range of from about 80° to 150° C. per minute to a temperature below which further thermal reaction will not occur and (e) aging said alloy body for a period ranging from about 8 to about 24 hours at one or more temperatures in the range of from about 600° to about 800° C.

12. The method of claim 11 wherein the initial alloy mass is prepared as an ingot by casting.

13. The method of claim 12 wherein during forging the casting is converted to a billet and at least some of the forging of the billet is carried out at temperatures below the $\gamma'$ precipitate solvus temperature.

14. The method of claim 11 wherein the initial alloy mass is prepared by powder metallurgy.

15. The method of claim 11 wherein the aging is carried out in two stages, the temperature during the second stage being lower than the temperature during the first stage.

16. The method of claim 11 wherein the $\gamma'$ precipitate solvus temperature is in the range of from about 1050° to about 1100° C.

* * * * *